US006130190A

United States Patent [19]

Gunsel et al.

[11] Patent Number: 6,130,190

[45] Date of Patent: Oct. 10, 2000

[54] LIQUID CRYSTAL AND SURFACTANT CONTAINING LUBRICANT COMPOSITIONS

[75] Inventors: Selda Gunsel, The Woodlands, Tex.; Frances E. Lockwood, Georgetown, Ky.

[73] Assignee: Pennzoil Products Company, Houston, Tex.

[21] Appl. No.: 08/965,612

[22] Filed: Nov. 6, 1997

[51] Int. Cl.[7] ..... C10M 105/62; C10M 111/02; C10M 141/06

[52] U.S. Cl. ..... 508/204; 508/165; 508/244; 508/243; 508/255; 508/389; 508/447; 508/463; 508/459; 508/552; 508/551; 508/538; 508/545; 508/579; 508/590; 508/110; 508/184; 508/207; 508/428; 508/543; 508/562; 508/588

[58] Field of Search ..... 508/110, 184, 508/207, 428, 447, 543, 562, 588, 165, 204, 244, 255, 243, 389, 463, 459, 552, 551, 538, 545, 579, 590

[56] References Cited

U.S. PATENT DOCUMENTS

| | | | |
|---|---|---|---|
| 2,606,874 | 8/1952 | Garner et al. . | |
| 4,414,241 | 11/1983 | Quella et al. | 427/2 |
| 4,781,848 | 11/1988 | Biresaw et al. | 252/49.5 |
| 4,781,849 | 11/1988 | Biresaw et al. . | |
| 4,999,122 | 3/1991 | Lockwood et al. | 252/32.5 |
| 5,026,577 | 6/1991 | Biresaw et al. | 428/1 |
| 5,266,222 | 11/1993 | Willis et al. | 252/49.6 |
| 5,410,424 | 4/1995 | Konuma et al. . | |
| 5,498,358 | 3/1996 | Kim et al. . | |

FOREIGN PATENT DOCUMENTS

| | | |
|---|---|---|
| 0 092 682 A1 | 11/1983 | European Pat. Off. . |
| 195 43 185 A1 | 5/1997 | Germany . |
| 58-001129 | 1/1983 | Japan . |
| 07 082582 | 9/1993 | Japan . |
| 06 128582 | 5/1994 | Japan . |
| 1 692 814 | 11/1991 | U.S.S.R. . |
| WO 98/15605 | 4/1998 | WIPO . |

OTHER PUBLICATIONS

K.J. Chugg et al., "Boundary lubrication and shear properties of thin solid films of dioctadecyl dimethyl ammonium chloride (TA100)", Journal of Physics D: Applied Physics, vol. 26, No. 11, Nov. 14, 1993, pp. 1993–2000.

*Primary Examiner*—Jerry D. Johnson
*Attorney, Agent, or Firm*—McDermott, Will & Emery

[57] ABSTRACT

A lubricating composition comprising a liquid crystal and a surfactant is disclosed. The inventive composition increase the lubricity of lubricant oils, reduce the wear rate or metals being lubricated, and increase the load bearing properties of lubricants between various surfaces, for example, within an engine and in the rolling of metals.

10 Claims, 1 Drawing Sheet

—*The region of the lamellar liquid crystalline phase in the systems of triethanomine (TEA), oleic acid (OLA), and polar solvents. Key (○) tetraethylene glycol; (□) triethylene glycol; (★) diethylene glycol; (●) ethylene glycol; (■) glycerol; 0.8 and 1.6 oleic acid—riethanolamine molar ratios are marked.*

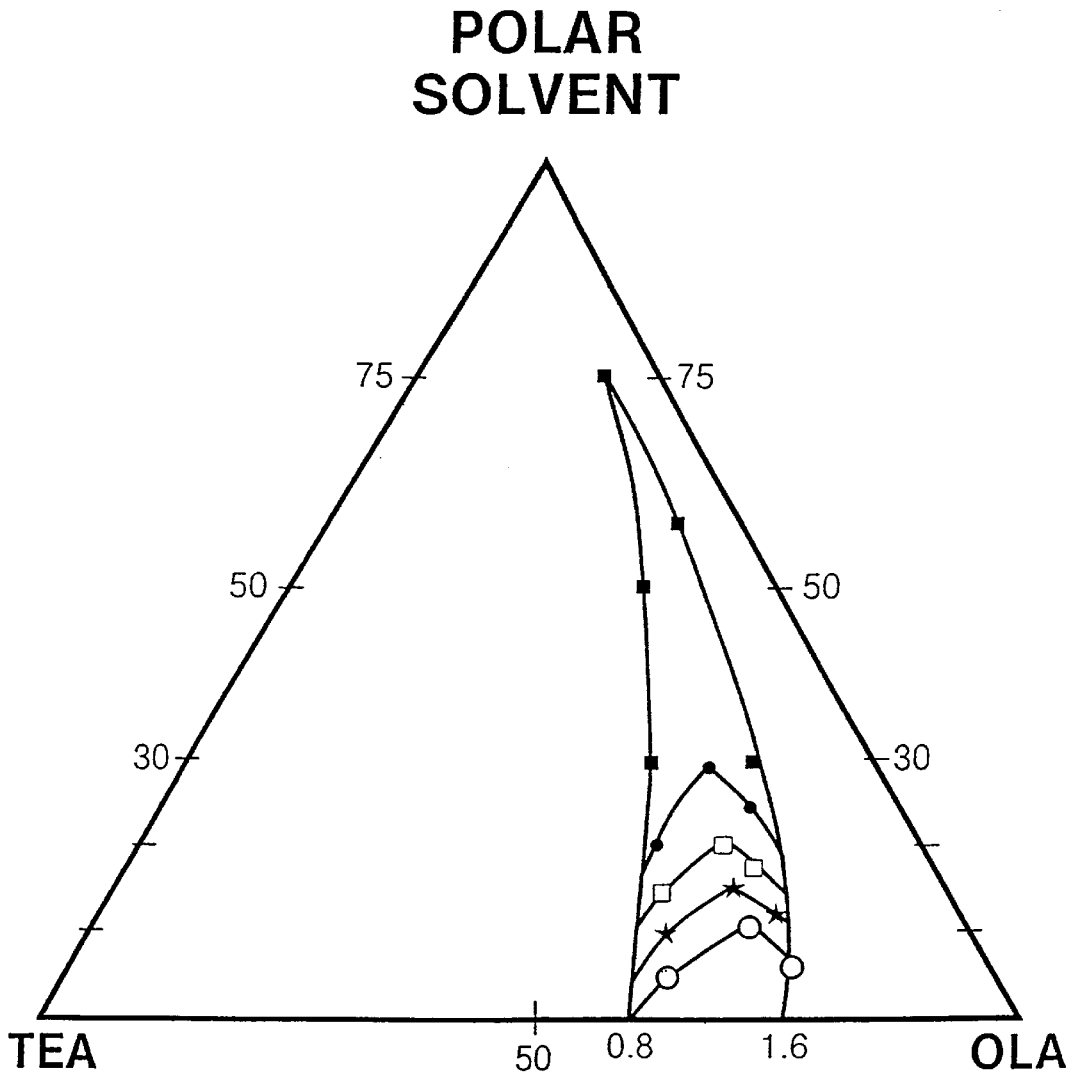
—The region of the lamellar liquid crystalline phase in the systems of triethanomine (TEA), oleic acid (OLA), and polar solvents. Key (○) tetraethylene glycol; (□) triethylene glycol; (★) diethylene glycol; (●) ethylene glycol; (■) glycerol; 0.8 and 1.6 oleic acid—riethanolamine molar ratios are marked.

LIQUID CRYSTAL AND SURFACTANT CONTAINING LUBRICANT COMPOSITIONS

TECHNICAL FIELD

The present invention relates to novel lubricant compositions for increasing lubricity of lubricant oils, reducing the wear rate of metals being lubricated, and increasing the load bearing properties of lubricants between various surfaces, for example, within an engine and in the rolling of metals.

BACKGROUND ART

Liquid crystalline compositions have not attracted as much attention within the field of lubrication as have more conventional chemical additives.

U.S. Pat. No. 5,498,358 discloses a lubricant composition for an internal combustion engine which comprises a lubricant basestock and an effective amount for antiwear properties of an oligomer containing at least one mesogenic segment and at least one flexible segment.

U.S. Pat. No. 4,781,849 describes a metalworking lubricant which comprises a lyotropic liquid crystal and certain defined amounts of natural or synthetic oils, water soluble surfactants, organic cosurfactants comprising certain 1,2-alkanediols and water containing less than about 1 wt % dissolved inorganic salts.

U.S. Pat. No. 3,982,215 discloses cutting oil compositions that are said to be like liquid crystals in that they exhibit birefringence. The compositions comprise a liquid hydrocarbon, water, an anionic surfactant and a cosurfactant which may be any of several different types of organ c compounds.

U.S. Pat. No. 2,606,874 discloses a water-in-oil emulsion readily dispersible in water and consisting essentially or mineral oil , water, a water-soluble anionic surfactant and a 1,2-alkanediol "coupling agent." None of these publications disclose or suggest the lubricant compositions of the present invention.

DISCLOSURE OF THE INVENTION

An object of the present invention is a friction reducing lubricant composition comprising a liquid crystal and a surfactant.

Additional objects, advantages and other features of the present invention will be set forth in part in the description which follows and in part will become apparent to those having ordinary skill in the art upon examination of the following or may be learned from the practice of the invention. The objects and advantages of the invention may be realized and obtained as particularly pointed out in the appended claims.

According to the present invention, the foregoing and other objects are achieved in part by a method of reducing friction comprising the step of providing a lubricating composition comprising a liquid crystal and a surfactant between two substrates.

Additional objects and advantages of the invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention.

Accordingly, the drawings and description are to be regarded as illustrative in nature, and not as restrictive.

BRIEF DESCRIPTION OF THE DRAWINGS

FIG. 1 illustrates the phase diagram for the TEAOL/glycerol system.

THE DRAWINGS

FIG. 1 depicts the region of the lamellar liquid crystalline phase in the systems of triethanomine (TEA), oleic acid (OLA), and polar solvents. Key (○) tetraethylene glycol; (□) triethylene glycol; (★) diethylene glycol; (●) ethylene glycol; (■) glycerol; 0.8 and 1.6 oleic acid—triethanolamine molar ratios are marked.

BEST MODE FOR CARRYING OUT THE INVENTION

In accordance with the present invention, provided is a friction reducing lubricant composition comprising a liquid crystal and a surfactant.

By "liquid crystal" it is meant highly anisotropic fluids that exist between the boundaries of the solid and conventional, isotropic liquid chase. The phase is a result of long-range orientational ordering among constituent molecules that occurs within certain ranges or temperature in melts and solutions of many organic compounds. In a preferred embodiment, the liquid crystal is aligned perpendicular.

Surface active agents, including friction modifiers, e.g., oleic acid, aligning agents, e.g., hexadecyltrimethyl ammonium bromide, and other surfactants, can be used to lower the surface tension of solid surfaces, thereby allowing the perpendicular alignment of liquid crystals, liquid crystal mixtures or liquid crystals in solution. When surfactant and LC are used in combination as a lubricant, either as a solution or by precoating solid surfaces with the surfactant, the surfactant lowers friction and the perpendicularly aligned LC, LC mix, or LC adsorbed from solution markedly increase longevity and load carrying capability, particularly in the prevention of stick-slip. Therefore, the surfactant-LC combination is a very effective friction reducing lubricant. An additional benefit of using surfactant-LC combinations is that many surfactants which are not oil-soluble can be solubilized in the LC solutions.

The liquid crystal may be a lyotropic or thermotropic liquid crystal. Examples of lyotropic liquid crystals include liquid crystal compositions comprising an organic acid component or a salt thereof, and an organic amine component. The organic acid component is selected from the group consisting of alkyl phosphonic acids, aryl phosphonic acids, alkyl sulfonic acids, aryl sulfonic acids and fatty acids. The weight ratios of the components are such that the compositions exhibit lamellar liquid crystalline properties, the weight ratio of organic acid to organic amine is in the range of 1:1 to about 5:1. The lamellar liquid crystal composition may contain non-aaueous solvent up to 75 weight percent of the composition. Preferred solvents include, but are not limited to, the group consisting of glycols such as glycerol, ethylene glycol, triethylene glycol, polyethylene glycol and the like, squalene, mineral oils, hydrocarbon esters such as pentaerythritol and isopropyl myristate, silicone fluids and the like.

In the case where the liquid crystal is a lyotropic liquid crystal, the lyotropic liquid crystal may further comprises a water-soluble alkanolamine. The water-soluble alkanolamine may be, for example, a monoethanolamine, diethanolamine, triethanolamine, dimethylethanolamine, diethyl-ethanolamine, amino-ethyl-ethanolamine, methyl-diethanolamine, N-acetyl ethanolamine, phenylethanolamine, phenyldiethanolamlne, monoisopropanolamine, di-isopropanolamine, tri-isopropanolamine, and/or mixtures thereof. Also, the liquid crystal material may comprise oleic acid and triethanolamine.

Examples of thermotropic liquid crystals include biphenyls, Schiff's bases, aromatic esters, azoxy compounds, and phenylcyclohexanes. Biphenyls include cyanobiphenyl compounds such as alkylbiphenylnitriles and alkyletherbiphenvlnitrlles and eutectic mixtures thereof (E-7, E-44, E-209). An example of Schiff's base type liquid crystal is p-methoxybenzylidene-p'-n-butylaniline (MBBA).

The lubricant compositions of the present invention comprise about 5% to about 95% by weight of liquid crystal, more preferably, about 10% to about 90% by weight of liquid crystal, most preferably, about 12% to about 93% by weight of liquid crystal.

By "surfactant" it is meant any agent with two structurally dissimilar groups within a single molecule and which is characterized by the following features.

Amphipathic structure. Surfactant molecules are composed of groups of opposing solubility tendencies, typically an oil-soluble hydrocarbon chain and a water-soluble ionic group.

Solubility. A surfactant is soluble in at least one phase of a liquid system.

Adsorption at interfaces. A: equilibrium, the concentration of a surfactant solute at a phase interface is greater than its concentration in the bulk of the solution.

Orientation at interfaces. Surfactant molecules and ions form oriented monolayers at phase interfaces.

Micelle formation. Surfactants form aggregates of molecules or ions called micelles when the concentration of the surfactant solute in the bulk of the solution exceeds a limiting value, the so-called critical micelle concentration (CMC), which is a fundamental characteristic of each-solute-solvent system.

Functional properties. Surfactant solutions exhibit combinations of cleaning, foaming, wetting, emulsifying, solubilizing, and dispersing properties.

The surfactants useful in the present invention include, for example nonionic surfactants, cationic surfactants, anionic surfactants, amphoteric surfactants, and mixtures thereof.

Nonionic surfactants carry no discrete charge when dissolved in aqueous media and include aliphatic esters, nitriles, urea, amines complexed with alcohols, aromatic acid esters, carboxylic acid esters, phenols complexed with aromatic amines, epoxy resins, polyamide resins, alkylphenyl ethers, polyoxyethylated glycols, fluoro polymers, and mixtures therrof.

Cationic surfactants comprise a hydrophobic moiety which carries a positive charge when dissolved in aqueous media. Examples of cationic surfactants include, by way of example, amines (oxygen-free and oxygen containing), 2-alkyl-1-(2-hydroxyethyl)-2-imidzolines, carboxylatochromium complexes, silane surfactants, such as octadecylorichlorosane, amines, quaternary ammonium compounds such as alkyl ammonium salts, alkylpyridine salts, alkylisoquinolinium salts and quaternary ammonium salts containing silicon and having a long alkyl chain. For example, the cationic surfactant may be a compound represented by the formula:

$$R^1{}_a N\, X_b\, R^2{}_c\, R^3{}_d\text{—}(Si\text{—}R^4{}_e)_f$$

wherein $R^1$ is a linear or branched alkyl group of about 8 to 30 carbon atoms;

$R^2$ is selected form the group consisting of linear or branched alkyl, or aryl;

$R^3$ is selected form the group consisting of linear or branched alkyl, or aryl;

$R^4$ is halogen, alkyl, alkoxy, aryl, or aryloxy;

X is selected from the group consisting of Fl, Cl, Br, I, At, H or $OR^5$; wherein $R^5$ is H, aryl, or alkyl;

d can be 0 or 1;

e or f can be 0, 1, 2, 3; and a, b, or c can be 1, 2, 3, with the proviso that the values of a, b, c, and d must add to five.

Preferred cationic surfactants are cetyltrimetylammoniumbromide, N,N-dimethyl-N-octadecyl-3-aminopropyl trimethoxy-silylchlor-de (DMOAP), and hexadecyltrimethylammonium bromide.

Anionic surfactants carry a negative charge and include carboxylates, cyclic carboxylic acids, fatty acids, aromatic acids, anionic complexes comprising carboxylic acid having a liquid crystal structure and a anionic surface active agents selected form the group consisting of cobalt, zinc naphthenate, sulfated alcohols, sulfated ethers, and mixtures thereof.

Ampholytic surfactants include liposomes and fatty esters. A preferred liposome is lecithin.

The liquid crystal composition comprises about 0.01% to about 8% by weight surfactant, more preferably about 0.1% to about 12% by weight surfactant, most preferably about 0.15% to about 15% by weight surfactant.

The inventive compositions may further comprise anti-wear agents, anti-oxidants, viscosity improvers, dispersants, antiwear agents and mixtures thereof as well as natural or synthetic oils.

The present invention further relates to a method for reducing friction comprising the step of providing applying a lubricating composition comprising a liquid crystal and a surfactant between two substrates. In this method, it is preferable that the liquid crystal is aligned perpendicular. In one embodiment, one substrate may be precoated with the lubricating composition. Solid surfaces Include, for example, metal and glass.

EXAMPLES

The following Examples illustrate the present invention and its various advantages in more detail.

Example 1

Friction tests were performed using a steel ball on flat glass in the Low Velocity Sliding Friction Apparatus. When no lubrication was used in the slow sliding experiment, contact friction was extremely high and resulted in scratching and metal transfer at very low loads. Applying solely oleic acid as a surfactant and lubricant in the slow sliding experiment permitted loads up to 300 gr. to be supported before stick-slip ensued (Table 1). The measured friction coefficient prior to stick-slip was 0.08–0.12. A better lubricant and surfactant, hexadecyltrimethylammonium bromide (HTAB) supported loads of up to 400 gr. for several hours when the HTAB surfactant was precoated on the glass. Its friction coefficient was measured to be 0.05–0.07. Applying the combination of HTAB surfactant and a cyanobiphenyl based eutectic mixture liquid crystal (referred to as E-7), however, greatly improved the longevity of supported loads before stick-slip occurred. In fact, loads of 400 gr. did not stick-slip for over 12 hours when the surfactant and liquid crystal lubricating combination was applied. The friction coefficient for the HTAB and liquid crystal E-7 combination was 0.05–0.07. Similarly, using HTAB and a solution of triethanol-ammonium oleate (TEAOL) liquid crystal (5%) in paraffin oil, allowed a load of 400 gr. to be supported for periods exceeding 17 hours. The friction coefficient was 0.05–0.07. A wear rate coefficient of $10^{-6}$ was calculated for the HTAB and triethanol-ammonium oleate liquid crystal combination. A wear rate coefficient of this magnitude is an excellent value for steel on glass, particularly in the absence of known antiwear agents. A number of other experiments have demonstrated the idea for steel on steel contacts, using fatty acids as the surfactants, and for various other liquid crystals. Control experiments with surfactant and paraffin oil were conducted to further demonstrate the increase lubricating benefit realized with the surfactant-liquid crystal combination (Table 1).

Example 2

Friction tests were performed on various surfactant and liquid crystal combinations using the Low Velocity Sliding Friction Apparatus an order to demonstrate the effects of alignment on lubrication properties (Table 2). Different types of surfactants including HTAB and alkoxysilane surfactant the general formula $RSiX_3$ were used to align biphenyl-based eutectic mixtures of liquid crystals (referred to as E-7, E-44 and E-209) and a single compound liquid crystal, p-methoxybenzylidene-p'-n-butylaniline (MBBA, . Adsorbed films of alkoxysilane surfactants on steel and glass align liquid crystals either parallel or perpendicular to the surface depending on the structure of the silane. For example, silane surfactant with long alkyl chains such as n,n-dimethyl-n-octadecyl-3-aminopropyltrimethoxysilychloride (DMOAP) orients liquid crystals perpendicularly on the surface. Silane surfactants with short alkyl chains such as N-methylaminopropyltrimethoxysilane (MAP) orients liquid crystals parallel to the surface. The combination of liquid crystals, E-7, E-44, E-209 and MBBA, with surfactants that provide perpendicular alignment (such as HTAB and DMOAP) produces effective lubricants, i.e., under slow sliding conditions stick-slip is prevented, friction is reduced and load carrying capability is increased (Table 2).

Example 3

Slow sliding friction experiments were conducted on various surfactant and lubricant combinations to demonstrate the lubrication benefit of using surfactants in combination with conventional lubricants such as paraffin oil and oleic acid (Table 3). The use of surfactants such as HTAB and DMOAP prevents stick-slip and reduces friction of paraffin oil, oleic acid and their mixtures.

Example 4

Slow sliding friction experiments were conducted on liquid crystals (E-7) and surfactants (HTAB) HTAB was used either as an additive in the liquid crystal or as a pre-coated film on the glass substrate. The surfactant was found effective in reducing friction either as an adsorbed film on the surface or as an additive in solution with the liquid crystal (Table 4).

Example 5

To further demonstrate the utility of a surfactant and liquid crystal lubricant formulation, friction and wear properties were measured in higher speed experiments. These tests were run under reciprocating contact conditions where a steel ball was oscillated against a glass disk under a load of 100 Newton (1.3 GPa contact pressure) at a frequency of 50 Hz and a stroke length of 1 mm. Tests were run for one hour at 30° C. For these experiments, liquid crystal mixtures were blended with 2.0 percent of an antiwear additive (a mixture of primary and secondary zincdialkyldithtophosphate). The results are shown in Table 5. The results indicate that the higher the isotropic transition temperaure of the liquid crystal, the lower the friction coefficient. Higher isotropic transition temperature indicates higher degree of ordering at room temperature. The results also indicate that the friction and wear properties of the liquid crystals either alone or with the surfactant HTAB are lower than that of conventional lubricants. The benefit of using surfactants in improving lubrication properties is evident in the paraffin oil as well as the liquid crystals.

Example 6

A number of oleic acid/triethanolamine (TEAOL) and TEAOL/glycerol mixtures were tested in the Low Velocity Sliding Friction Apparatus. The mixtures were prepared over a range of formulations corresponding to the various regions of the three-phase diagram (FIG. 1).

The friction tests were conducted under the following identical conditions: 52100 steel ball/disc, 100 gr. load, ambient temperature, and 2.5 cm/min sliding speed. The results are shown in Table 6. The mixtures have low friction ($\mu$: 0.08–0.10) for compositions within the liquid crystalline region and on the "acid-side" of the phase diagram, where two phases, including a solid precipitate, were present. In the liquid crystalline region, the mixtures were homogeneous and exhibited good stability. These mixtures were grease-like in consistency. On the "amine-side" of the diagram, two- phase liquid compositions produced higher friction and stick-slip.

Several commercial friction modified oils and greases were also tested in the Low Velocity Sliding Friction Apparatus. The results are presented in Table 7. A comparison of these values with those in Table 6 demonstrates that the liquid crystal formulations have low friction coefficients which were comparable to commercial oils and greases.

TABLE 1

Friction Coefficient Measured Under Slow Sliding Conditions (steel ball on glass flat)
Test Conditions: steady state repeated passes in slow (2.5 cm/min.) sliding 52100 steel ball on glass flat, ambient temperature.

| Lubricant | Load, gr. (Contact Pressure, GPa) | Friction Coefficient |
|---|---|---|
| Oleic Acid | 20(0.14) | 0.03 |
| | 50(0.19) | 0.08–0.09 |
| | 300(0.34) | 0.08–0.11→ stick-slip |
| | 400(0.38) | 0.12→ stick-slip |
| HTAB (dry film) | 100(0.24) | 0.05 |
| | 300(0.34) | 0.05 |
| | 400(0.38) | 0.05–0.07 |
| E–7 on HTAB film | 100(0.24) | 0.06 |
| | 300(0.34) | 0.05–0.06 |
| | 400(0.38) | 0.05–0.07 |
| Paraffin oil with 5% TEAOL on HTAB film | 400(0.38) | 0.05–0.07 |
| Paraffin oil | 400(0.38) | stick-slip |
| Paraffin oil on HTAB film | 400(0.38) | 0.05–0.15 |

TABLE 2

Friction Coefficients Measured Under Slow Sliding Conditions (steel ball on glass flat)

| Liquid Crystal/Surfactant | Orientation | Load, gr. | Friction Coefficient |
|---|---|---|---|
| E-7/no surfactant | self aligned (non-uniform parallel) | 400 | stick-slip |
| E-7/DMOAP | perpendicular | 400 | 0.06–0.08 |
| E-7/HTAB | perpendicular | 400 | 0.05–0.07 |
| E-7/MAP | parallel | 400 | stick-slip |
| E-44/no surfactant | self aligned (non-uniform parallel) | 400 | stick-slip |
| E-44/DMOAP | perpendicular | 400 | 0.07–0.08 |
| E-44/HTAB | perpendicular | 400 | 0.06–0.08 |
| E-44/MAP | parallel | 400 | stick-slip |
| E-209/no surfactant | self aligned (non-uniform parallel) | 400 | stick-slip |
| E-209/DMOAP | perpendicular | 400 | 0.06–0.07 |
| E-209/HTAB | perpendicular | 400 | 0.07–0.08 |
| E-209/MAP | parallel | 400 | stick-slip |
| MBBA/no surfactant | self aligned (non-uniform parallel) | 400 | stick-slip |
| MBBA/HTAB | perpendicular | 400 | 0.06–0.08 |

TABLE 3

Friction Coefficients Measured Under Slow Sliding Conditions (steel ball on glass flat)

| Lubricant/Surfactant | Load, gr. | Friction Coefficient |
|---|---|---|
| paraffin oil | 400 | stick-slip |
| paraffin oil/HTAB | 400 | 0.06 |
| oleic acid | 400 | 0.12 |
| oleic acid/HTAB | 400 | 0.07 |
| 2 wt % oleic acid in paraffin oil/MAP | 400 | stick-slip, 0.2–0.3 |
| 2 wt % oleic in paraffin oil/MAP | 400 | 0.085–0.11 |

TABLE 4

Effect of Aligning Agent Adsorbed on the Surface vs. as an Additive in Solution

| Lubricant | Load, gr. | Friction Coefficient |
|---|---|---|
| liquid crystal on adsorbed HTAB film | 100 | 0.05 |
| | 200 | 0.06 |
| | 400 | 0.06 |
| liquid crystal with 0.5 wt % HTAB added | 100 | 0.05 |
| | 200 | 0.07 |
| | 400 | 0.07 |

TABLE 5

Friction and Wear Properties under High Speed, Reciprocating Contact Conditions

| Lubricant | ITT(° C.) | Friction Coefficient | Wear Coefficient × $10^6$ |
|---|---|---|---|
| E-7 | 60.5 | 0.16 | 2.2 |
| E-7 on HTAB film | — | 0.15 | 1.8 |
| E-44 | 100.0 | 0.09 | 1.9 |
| E-44 on HTAB film | — | 0.09 | 2.0 |

TABLE 5-continued

Friction and Wear Properties under High Speed, Reciprocating Contact Conditions

| Lubricant | ITT(° C.) | Friction Coefficient | Wear Coefficient × $10^6$ |
|---|---|---|---|
| E-209 | 111.0 | 0.08 | 6.7 |
| E-209 on HTAB film | — | 0.08 | 2.4 |
| Paraffin Oil | — | seized | 15.7 |
| Paraffin Oil on HTAB film | — | 0.135 | 4.7 |

TABLE 6

Slow-sliding Friction Coefficients of LCs.

| Liquid Crystal | Friction coefficient | Viscosity(2) (poise) |
|---|---|---|
| TEAOL(0.8)(3) | 0.095 | 29 |
| TEAOL(1.0) | 0.095 | — |
| TEAOL(1.2) | 0.095 | 31 |
| TEAOL(1.4) | 0.088 | 32 |
| TEAOL(1.6) | 0.085 | 26 |
| TEAOL(1.6), glycerol 20% by weight | 0.093 | 35 |
| TEAOL(1.6), glycerol 30% | 0.094 | — |
| TEAOL(1.6), glycerol 40% | 0.095 | 26 |
| TEAOL(1.6), glycerol 60% | 0.100 | 17 |
| TEAOL(1.2), glycerol 30% | 0.095 | 22 |
| TEAOL(1.4), glycerol 30% | 0.100 | 26 |
| TEAOL(1.0), glycerol 30% | 0.100 | — |
| TEAOL(1.8), glycerol 30% | 0.080 | 32 |
| TEAOL(2.2), glycerol 30% | 0.080 | 20 |

(1)Steady-state repeated passes in slow (2.5 cm/min) sliding, ball on flat, ambient, 52100 steel, Ra = 0.02 $\mu$m, ~70% humidity, 0.27 GPa Hertz pressure.
(2)Measured at 1000 $sec^{-1}$ and ambient temperature.
(3)Triethanolammonium oleate (0.8 M oleic acid/M triethanolamine).

TABLE 7

Slow-sliding friction coefficients of commercial lubricants.

| Lubricant | Friction coefficient(1) | Viscosity(2) (poise) |
|---|---|---|
| 10W-30 motor oil | Stick-slip, 0.125 | 1.2 |
| Synthetic 15W-30 SE/CD oil | 0.115 | 1.3 |
| Lithium soap graphite grease | 0.088 | 21.6 |
| Lithium soap grease A | 0.095 | 19.2 |
| Lithium soap grease B | 0.100 | 19.2 |
| Halocarbon grease | 0.160 | 540.0 |

(1)Steady-state repeated passes in slow (2.5 cm/min) sliding, ball on flat, ambient, 52100 steel, Ra = 0.02 $\mu$m, ~70% humidity, 0.27 GPa Hertz pressure.
(2)Measured at 1000 $sec^{-1}$and ambient temperature.

In the previous description, numerous specific details are set forth, such as specific structures, chemicals, processes, etc., to provide a thorough understanding of the present invention. However, as one having ordinary skill in the art would recognize, the present invention can be practiced without resorting to the details specifically set forth. In other instances, well know processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

We claim:

1. A friction reducing lubricant composition consisting essentially of:

(a) a liquid crystal and (b) a perpendicular aligning surfactant selected from the group consisting of nonionic surfactants, cationic surfactants, anionic surfactants, and mixtures thereof, wherein the liquid crystal is aligned perpendicular and wherein said nonionic surfactants are selected from the group consisting of aliphatic esters, nitriles, urea, amines complexed with alcohols, aromatic acid esters, phenols complexed with aromatic amines, epoxy resins, polyamide resins, alkylphenyl ethers, polyoxyethylated glycols, fluoro polymers, and mixtures thereof;

said cationic surfactants are selected from the group consisting of 2-alkyl-1-(2-hydroxy-ethyl)-2-imidzolines, alkylpyridine salts, alkylisoquinolinium salts and quaternary ammonium salts containing silicon and having a long alkyl chain; and said anionic surfactants are selected from the group consisting of cyclic carboxylic acids, aromatic acids, and anionic complexes comprising carboxylic acid having a liquid crystal structure and anionic surface active agents selected form the group consisting of cobalt, zinc naphthenate, sulfated alcohols, sulfated ethers, and mixtures thereof.

2. The composition of claim 1, wherein the composition consists essentially of about 0.15% to about 15% by weight of the surfactant.

3. The composition of claim 1, wherein the liquid crystal is a polymer with at least one mesogenic unit.

4. The composition of claim 1, wherein the liquid crystal is a thermotropic liquid crystal selected from the group consisting of biphenyls, Schiff's bases, aromatic esters, azoxy compounds, and phenylcyclohexanes.

5. The composition of claim 1, wherein the liquid crystal is a lyotropic liquid crystal compound having an organic acid component and an organic amine component.

6. The composition of claim 5, wherein the liquid crystal is oleic acid and triethanolamine.

7. The composition of claim 1, further consisting essentially of a natural or synthetic oil.

8. The composition of claim 1, wherein the composition consists essentially of (i) about 5% to about 95% by weight of cyanobiphenyl compounds as the liquid crystal, (ii) about 0.15% to about 15% by weight of N,N-dimethyl-N-octadecyl-3-aminopropyltrimethoxysilylchloride as the surfactant and (iii) an oil.

9. The composition of claim 1, further consisting essentially of anti-wear agents, anti-oxidants, viscosity improvers, dispersants and mixtures thereof.

10. A friction reducing lubricant composition consisting essentially of a liquid crystal and a perpendicular aligning surfactant consisting of cetyltrimethyl-ammonium bromide, wherein the liquid crystal is aligned perpendicular.

* * * * *